United States Patent [19]

Rheingold

[11] 4,043,301

[45] Aug. 23, 1977

[54] INTERNAL COMBUSTION ENGINE

[75] Inventor: Lawrence M. Rheingold, Baldwin, N.Y.

[73] Assignee: Templet Industries Incorporated, Plainview, N.Y.

[21] Appl. No.: 686,211

[22] Filed: May 24, 1976

Related U.S. Application Data

[63] Continuation-in-part of Ser. No. 588,876, June 20, 1975, abandoned.

[51] Int. Cl.[2] ..... F02B 75/18

[52] U.S. Cl. ..... 123/52 B; 123/45 R; 123/56 AC; 123/56 BC

[58] Field of Search ..... 123/45 R, 45 A, 51 R, 123/51 AA, 51 BA, 52 R, 52 A, 52 B, 53 R, 53 AA, 53 BA, 53 A, 53 B, 56 R, 56 A, 56 AC, 56 B, 56 BC, 197 R, 58 C; 92/72, 107; 74/753, 764, 770, 789

[56] References Cited

U.S. PATENT DOCUMENTS

| | | | |
|---|---|---|---|
| 1,195,052 | 8/1916 | McElwain | 74/753 X |
| 1,231,572 | 7/1917 | Davis | 123/56 AA |
| 1,476,307 | 12/1923 | Toth | 123/52 A |
| 1,576,837 | 3/1926 | Marr | 123/52 B |
| 3,400,702 | 9/1968 | Watkins | 123/53 B |
| 3,805,524 | 4/1974 | Bachmann | 123/52 B |
| 3,866,581 | 2/1975 | Herbert | 123/51 R |

*Primary Examiner*—Carroll B. Dority, Jr.
*Assistant Examiner*—Craig R. Feinberg
*Attorney, Agent, or Firm*—Fitch, Even, Tabin & Luedeka

[57] ABSTRACT

An internal combustion engine is disclosed having opposed, axially aligned, annular reciprocating and rotatable pistons connected through radially disposed crankshafts to a drive shaft which extends coaxially of the opposed pistons. The crankshafts are so supported to permit rotation about the axis of the drive shaft when a clamping brake is released, as during an idle condition. Planetary cam plates are rotated by and in timed relation to the crankshafts and serve to control valve and ignition operation for four cycle operation.

28 Claims, 13 Drawing Figures

INTERNAL COMBUSTION ENGINE

This is a continuation-in-part of application Ser. No. 588,876, filed June 20, 1975 and now abandoned, and relates generally to internal combustion engines, and more particularly to a novel compact internal combustion engine having opposed, axially aligned, reciprocating and rotatable pistons and a drive shaft disposed coaxially of the pistons.

In accordance with the present invention, an internal combustion engine is provided which employs opposed, axially aligned, reciprocating pistons which have annular configurations and are rotatable within annular chambers. The pistons are connected through radially disposed crankshafts to a drive shaft disposed coaxially of the pistons. A feature of the present invention lies in the provision of a gimbal frame which supports the crankshafts and facilitates rotation of the crankshafts and pistons about the axis of the drive shaft such that the engine may be maintained in an operating condition while the drive shaft remains stationary.

Another feature of the invention is the provision of a clamping brake or clutching means operative with the gimbal frame to selectively prevent or allow rotation of the pistons and associated crankshafts about the axis of the drive shaft. Actuation of the clamping brake to prevent rotation of the cranks and pistons effects driving rotation of the drive shaft, while release of the clamping brake allows the pistons and cranks to rotate about the axis of the drive shaft.

An additional feature of the invention lies in the provision of planetary cam plates which lie in planes normal to the axis of the drive shaft and are rotatably driven by and in timed relation to the crankshafts. The cam plates actuate valve push rods and control the ignition system for proper timing in a four cycle engine embodiment of the invention.

A further feature of the invention lies in the provision of a stepless transmission between opposed axially reciprocal pistons and a drive shaft whereby a highly variable drive means is obtained.

Another feature of the present invention lies in the provision of hydrostatic means to control rotation of the gimbal frame so as to allow forward rotation, stopping or reverse rotation of the gimbal frame relative to the drive shaft, reverse rotation of the gimbal frame facilitating an overdrive condition of the engine.

Additional features and advantages of the present invention will become apparent from the following detailed description of the invention when taken in conjunction with the accompanying drawings wherein like reference numerals designate like elements throughout the several views, and wherein.

Figure 1:
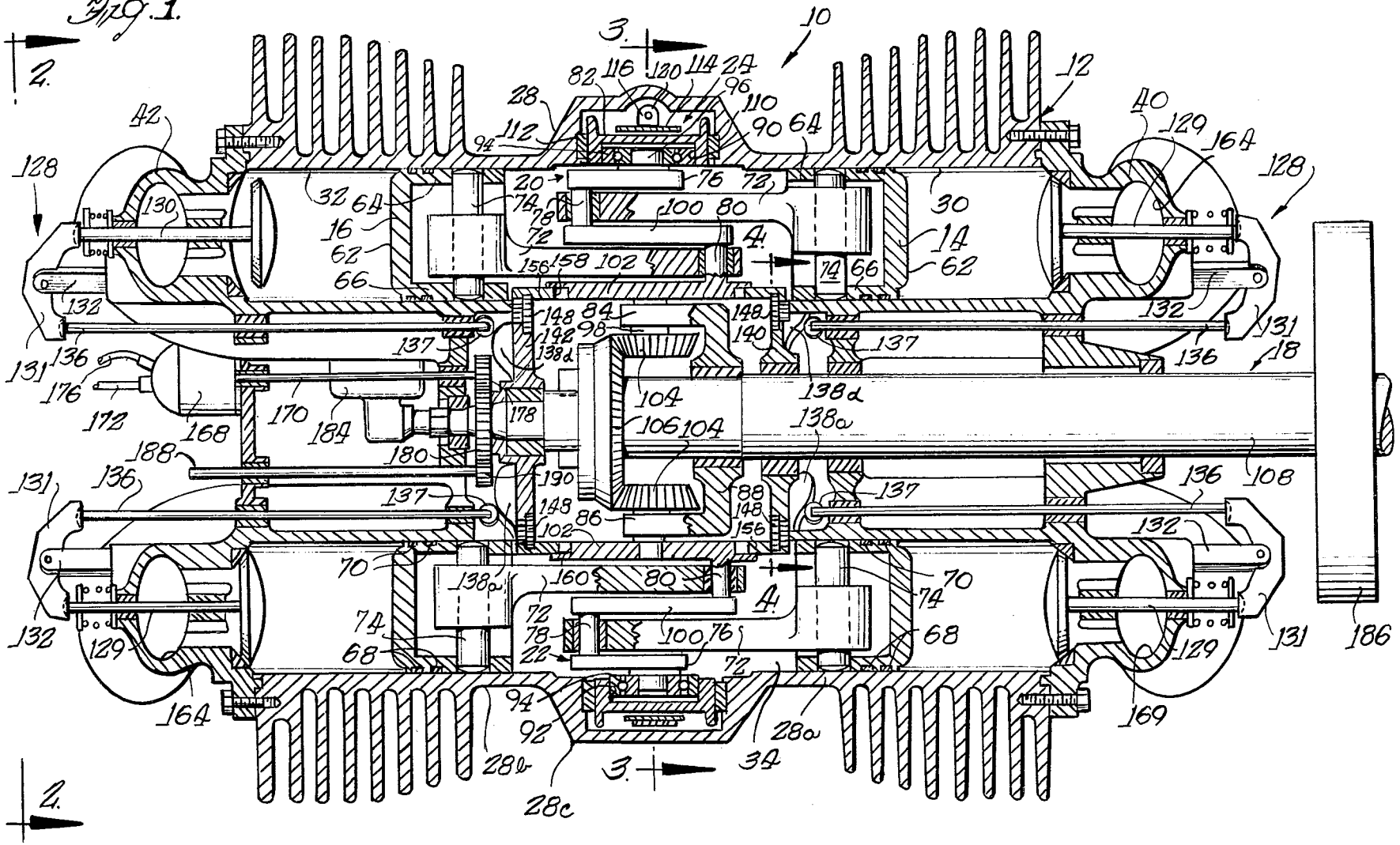
FIG. 1 is a longitudinal sectional view of a four cycle internal combustion engine constructed in accordance with the present invention.
Figures 2, 5, 6, 7:
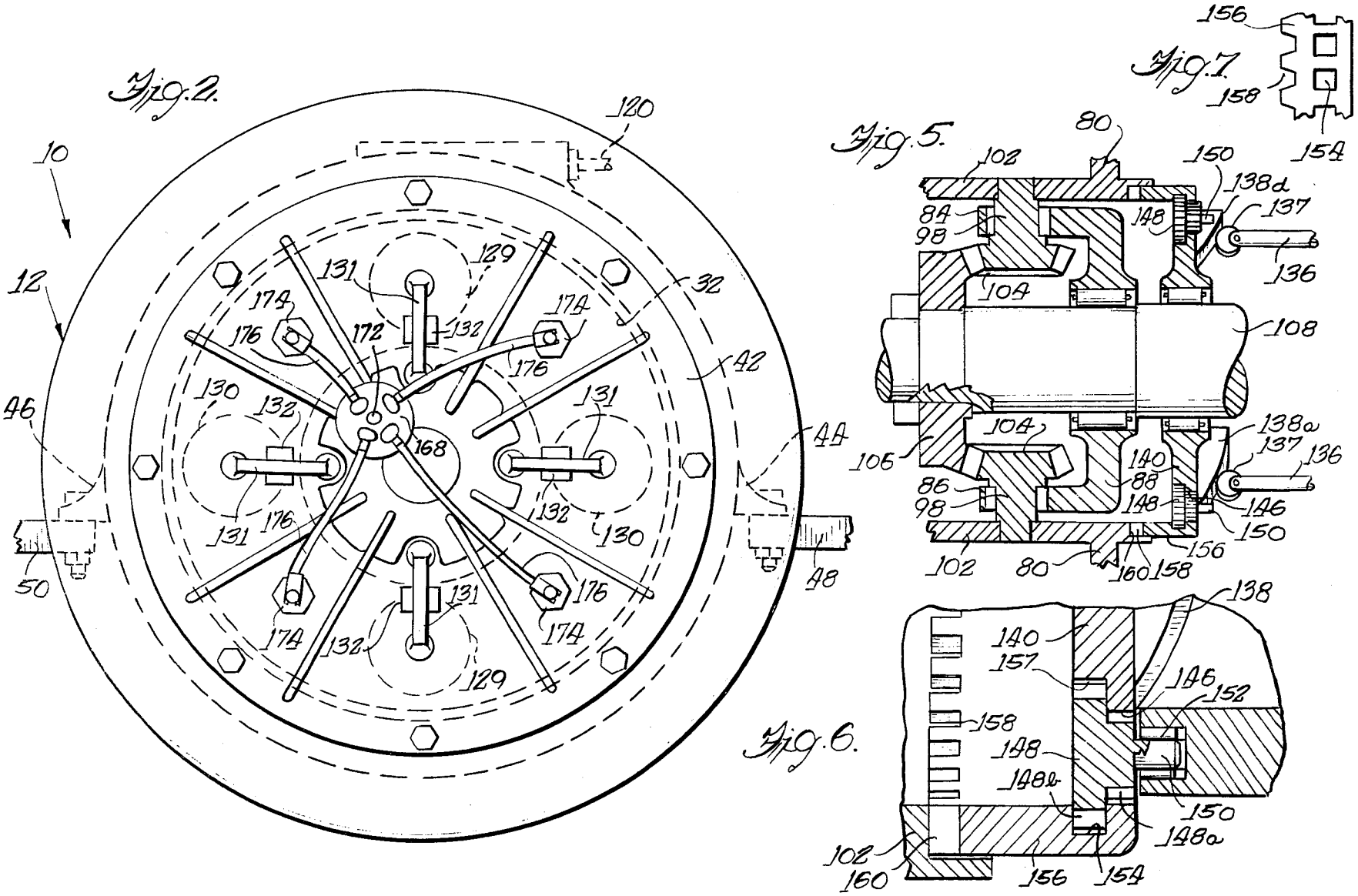
FIG. 2 is an end view of the engine of FIG. 1, taken substantially along the line 2—2 of FIG. 1, looking in the direction of the arrows.
FIG. 5 is an enlarged partial longitudinal sectional view showing one of the planetary cam plates operatively associated with the axially aligned radially opposed crankshafts.
FIG. 6 is an enlarged portion of the sectional view of FIG. 5.
FIG. 7 is an enlarged detail view of a segment of the timing ring gear of FIG. 6.

Referring now to the drawings, and in particular to FIGS. 1 and 2, an internal combustion engine constructed in accordance with the present invention is indicated generally at 10. The illustrated engine 10 is of the four-cycle type. As will become more apparent hereinbelow, the various features of the engine 10 may be readily incorporated into a two-cycle engine. Briefly, the internal combustion engine 10 includes housing means, indicated generally at 12, piston means in the form of a pair of opposed axially aligned annular pistons 14 and 16 disposed within the housing means 12 and reciprocally and rotatably operable to effect selective rotation of drive shaft means, indicated generally at 18, disposed coaxially of the pistons 14 and 16.

The pistons 14 and 16 are operatively connected, respectively, to the drive shaft means 18 through crankshaft means, indicated generally at 20 and 22, such that reciprocating movement of the pistons 14 and 16 during operation of the engine will effect driving rotation of the drive shaft means 18. The crankshaft means 20 and 22 and the associated pistons 14 and 16 are mounted within the housing means 12 such that the pistons and crankshaft means may rotate about the axis of the drive shaft means 18 with the drive shaft means in a non-rotating condition, or alternatively, the crankshaft means and pistons may be prevented from rotating about the drive-shaft axis such that reciprocating movement of the pistons 14 and 16 effects driving rotation of the drive shaft means 18. To this end, brake means in the form of a clamping brake, indicated generally at 24, is provided which is selectively operable between a braking position preventing rotation of the crankshaft means and pistons about the axis of the drive shaft means 18, and a release position which allows rotation of the pistons and crankshaft means about the axis of the drive shaft means 18 when it is stationary relative to the housing means 12. In an alternative embodiment to be described hereinbelow in conjunction with FIGS. 10 and 11, means are provided for rotating the crankshaft means 20 and 22 and pistons 14 and 16 about the axis of the drive shaft means 18 so as to effect an overdrive operating condition.

In the illustated embodiment, the housing means 12 includes an annular housing or block 28 having opposite end portions 28*a* and 28*b* and an intermediate portion 28*c*. The housing means 12 includes end housings or "heads" 40 and 42 which are mounted on and cooperate with the housing 28 to define axially aligned annular piston receiving chambers 30 and 32 within the end portions 28*a* and 28*b*, respectively. The piston receiving chambers 30 and 32 are of identical configuration and intersect a centrally disposed chamber 34. The heads 40 and 42 serve to substantially close the outer ends of the piston chambers 30 and 32 except for intake and exhaust valve porting to be described more fully hereinbelow.

The housing 28 includes a pair of motor mounts 44 and 46, (FIG. 2) which are formed integral with or otherwise suitably secured to the outer surface of the housing 28 to facilitate mounting of the engine 10 on suitable external frame support mounts, portions of which are illustrated at 48 and 50. It will be appreciated that the motor mounts 44 and 46 may be secured to the frame supports 48 and 50, respectively, by any simple means so as to maintain the housing means 12 in a fixed nonrotating position.

The illustrated embodiment of the engine 10 is adapted for air cooling. It will be understood that annular inner and outer coolant chambers could be provided about each of the piston receiving chambers 30 and 32 within the housing 28, with suitable conduits and fittings being provided in fluid communication with each of the coolant chambers for introducing and circulating water or other suitable coolant within the coolant chambers from a conventional heat exchanger such as a radiator or the like.

The annular pistons 14 and 16 are of identical configuration and are reciprocally slidable and rotatable within their respective chambers 30 and 32. Each of the pistons 14 and 16 has an annular head surface 62 and radially spaced coaxial annular skirt walls 64 and 66. Each of the pistons has suitable piston ring grooves 68 and 70 formed in the annular skirt walls 64 and 66, respectively, to receive compression rings and one or more oil rings, as is known.

In the illustrated embodiment, each of the pistons 14 and 16 has two connecting rods 72 pivotally connected thereto as diametrically opposite positions through wrist pins 74 which are in axial alignment. The connecting rods 72 are of identical configuration and have their ends opposite their pivotal connections to the pistons 14 and 16 connected to the crankshaft means 20 and 22 as shown.

The crankshaft means 20 and 22 comprise identical crankshafts 76. Each crankshaft 76 has a pair of axially spaced substantially diametrically opposed connecting rod bearing journals 78 and 80 to which are pivotally connected the ends of each pair of opposed connecting rods 72 opposite their pivotal connections to the pistons 14 and 16. The connecting rod bearing journals 78 and 80 constitute the "throws" of the crankshafts 76.

Figure 3:
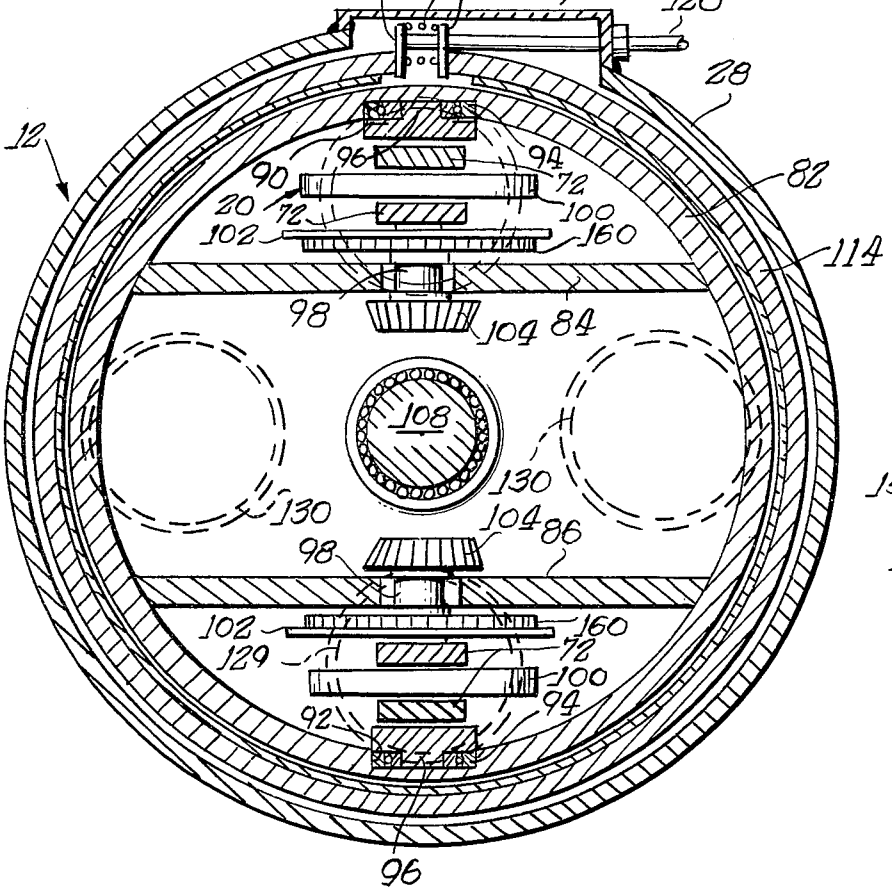
FIG. 3 is a transverse sectional view taken substantially along the line 3—3 of FIG. 1, looking in the direction of the arrows.

The crankshafts 76 are supported within a gimbal framework which includes an outer annular gimbal ring 82 and inner support arms 84 and 86. The inner support arms 84 and 86 may be formed integral with or otherwise suitably secured to a C-shaped beam 88 the outer ends of which are secured to the inner surface of the outer gimbal ring 82 such that the beam 88 lies on a diameter of the ring 82, as best seen in FIG. 3.

The outer gimbal ring 82 has a pair of diametrically opposed recesses 90 and 92 formed in its inner surface, each recess receiving a suitable bearing 94. Each of the bearings 94 receives an outer cylindrical end portion 96 of one of the crankshafts 76. Each of the crankshafts 76 has an inner cylindrical end portion 98 which is suitably journaled within an associated one of the support arms 84 or 86 of the cross beam 88, the inner end portions 98 being in axial alignment with the respective outer end portions 94 of the crankshafts.

Each of the crankshafts 76 has a circular fly wheel 100 formed thereon which is disposed between the bearing journals 78 and 80 and suitably supports the bearing journals. Each of the crankshafts 76 also includes a timing spur gear 102 which is formed integral with or otherwise suitably secured on each of the crankshafts axially adjacent the inner cylindrical end 98 thereof. It will be understood that each of the crankshafts is suitably dynamically balanced relative to its axis of rotation as established by the ends 94 and 98 thereof.

The crankshafts 76 interconnect the pistons 14 and 16 to the drive shaft means 18 through beveled gears 104 which are secured to the end portions 98 of the crankshafts. The beveled gears 104 are positioned radially inwardly of the arms 84 and 86 of the gimbal beam 88. The bevel gears 104 mesh with a bevel ring gear 106 formed on an elongated drive shaft 108 of the drive shaft means 19. The drive shaft 108 is supported by the heads 40 and 42 through suitable bearings for rotation about an axis coincident with the common axis of the pistons 14 and 16.

The outer gimbal ring 82 of the gimbal frame is maintained in fixed axial relation relative to the housing 28 by annular guide rings 110 and 112 which are suitably retained by the housing 28 and lie in parallel axially spaced planes normal to the axis of shaft 108. The annular gimbal ring 82 is rotatable about its own axis, which coincides with the axis of drive shaft 108, between the guide rings 110 and 112. A flat friction brake or clamping band 114, which forms a part of the clamping brake 24, is disposed between the outer peripheral surface of the gimbal ring 82 and the adjacent inner peripheral surface of the housing portion 28*c*. The brake band 114 extends around substantially the full periphery of the outer gimbal ring 82 and has outwardly projecting arms 116 and 118 (FIG. 3) secured to the opposite ends of the brake band. The arms 116 and 118 are connected to an actuator control rod 120 which, in turn, is cooperative with suitable control means (not shown) to tighten the brake band 114 against the outer peripheral surface of the gimbal ring 82 and prevent rotation of the gimbal framework about the axis of the drive shaft 108, or loosen the brake band and allow rotational movement of the gimbal framework and associated cranks 76 and pistons 14 and 16 about the axis of the drive shaft 108. In the illustrated embodiment, a compression spring 122 is disposed about the rod 120 between the arms 116 and 118 and urges the arms apart to bias the brake band to a loosened condition. The illustrated actuator control rod 120 is representative of a number of alternative actuators that could be employed to carry out the desired braking control. The brake band 114 could be V-shape or other suitable configuration cooperable with a complementary outer braking surface on the gimbal ring 82, or it may be of a disc type or other suitable braking or clutching means. The actuator control rod 120 and associated brake band 114 constitute the clamping brake 24 of the embodiment of FIG. 1, it being noted that the actuator control means may include an electrically operated solenoid actuator or other suitable brake band control.

The piston head surfaces 62 of the pistons 14 and 16 cooperate, respectively, with the heads 40 and 42 on the housing 28 to define combustion chambers within the piston chambers 30 and 32. Introduction of fuel charges into the combustion chambers with subsequent ignition effects movement of the pistons 14 and 16 toward each other in power strokes which actuate the connecting rods 72 in an opposing rotational manner, i.e. for each piston, one connecting rod will rotate its associated crankshaft 76 in a clockwise direction while the other connecting rod on the same piston will rotate the other crankshaft 76 in a counterclockwise direction. If the clamping brake 24 is actuated to prevent rotation of the gimbal ring 82 and associated crankshafts and pistons about the axis of the drive shaft 108, rotation of the crankshafts 76 will effect rotation of the drive shaft 108. To control the introduction of combustible fuel into the combustion chamber associated with each of the pistons 14 and 16, valve means, indicated generally at 128, are provided for each piston chamber. The valve means 128 associated with each of the pistons 14 and 16 includes a plurality of intake valves 129 and a plurality of exhaust valves 130. In the illustrated embodiment, the intake and exhaust valves 129 and 130, respectively, are of the poppet type and are supported for axial movement by suitable sleeve guides such that the heads of the valves are disposed within the respective combustion chambers. The valves 129 and 130 are cooperable with associated intake and exhaust orifices formed in the heads 40 and 42 and are biased to closed positions as is known. The intake valves 129 are operable to allow the introduction of fuel charges into the combustion chambers, while the exhaust valves 130 are operable at a predetermined later time during a firing cycle to allow escape of the exhaust gases.

The intake and exhaust valves 129 and 130 are each operated by an associated rocker arm 131 which is supported on a rocker support arm 132 secured in normal relation to a support plate 134 affixed to the associated heads 40 and 42. Each of the rocker arms 131 has its end opposite the associated intake or exhaust valve 129 and 130 cooperative with a push rod 136 which is supported for axial movement. The push rods 136 extend parallel to the axis of drive shaft 108, and have their ends opposite the associated rocker arms 131 cooperable through follower rollers 137 (FIG. 5) with associated cam lift lobes 138 formed on two planetary cam plates 140 and 142.

With particular reference to FIGS. 3–7, taken in conjunction with FIG. 1, the planetary cam plates 140 and 142 are substantially circular and are provided within the chamber defined within the central housing portion 28*c.* Each of the planetary cam plates 140 and 142 is rotatably supported on the drive shaft 108 through suitable anti-friction bearings such that the planetary cam plates are rotatable about their center axes in planes normal to the axis of the drive shaft 108. The planetary cam plate 140 controls proper sequential actuation of the intake and exhaust valves 129 and 130 associated with the piston 14, while the planetary cam plate 142 controls proper sequential actuation of the intake and exhaust valves associated with piston 16.

To effect proper sequential operation of the intake and exhaust valves 129 and 130 with their respective pistons 14 and 16, the planetary cam plates 140 and 142 are coupled in driven relation to the timing gears 102 on the crankshafts 76. To this end, each of the planetary cam plates 140 and 142 has spur gear teeth 146 formed on its annular peripheral surface which mesh in driven relation with spur gear teeth 148*a* on four stepped idler gears 148 rotatably supported in circumferential equidistantly spaced relation about the planetary cam plates on the inner ends of annular wall portions 40*a* and 42*a* of the heads 40 and 42, respectively. Each of the idler gears 148 has an axial stub shaft 150 received within and supported by a suitable bearing 152 retained within an associated one of the annular walls 40*a* and 42*a* of the heads 40 and 42, as best seen in FIG. 6.

The idler gears 148 also have spur gear teeth 148*b* thereon which have greater pitch diameters than the gear teeth 148*a* and mesh with annular racks 154 (FIG. 7) formed in annular timing ring gears 156. The planetary cam plates 140 and 142 are recessed at 157 to provide clearance for the teeth 148*b* on the stepped idler gears 148. Each of the timing ring gears 156 has annular gear teeth 158 formed thereon which are cooperable with spur gear teeth 160 formed on each of the timing spur gears 102 on the crankshafts 76. The timing spur gears 102, annular timing ring gears 156, stepped idler gears 148 and planetary cam plates 140 and 142 are formed so that the cam plates 140 and 142 rotate about the axis of the drive shaft 108 in constant timed relation to rotation of the crankshafts 76 about their own axes, rotation of the crankshafts 76 about their axes being a function of piston position and reciprocating speed. For the illustrated four-cycle engine 10, the planetary cam plates 140 and 142 are caused to rotate one revolution during each two revolutions of the crankshafts 76 or, alternatively, for each two stroke cycles of the pistons 14 and 16. Similarly, the drive shaft 108 rotates one revolution during each two revolutions of the crankshafts 76. The timed relationship of the planetary cam plates 140 and 142 to piston position is thus maintained irrespective of whether the pistons and associated crankshafts 76 are rotationally fixed relative to the axis of the drive shaft 108 or are allowed to rotate about the axis of the drive shaft as in an idle condition.

Figure 4:
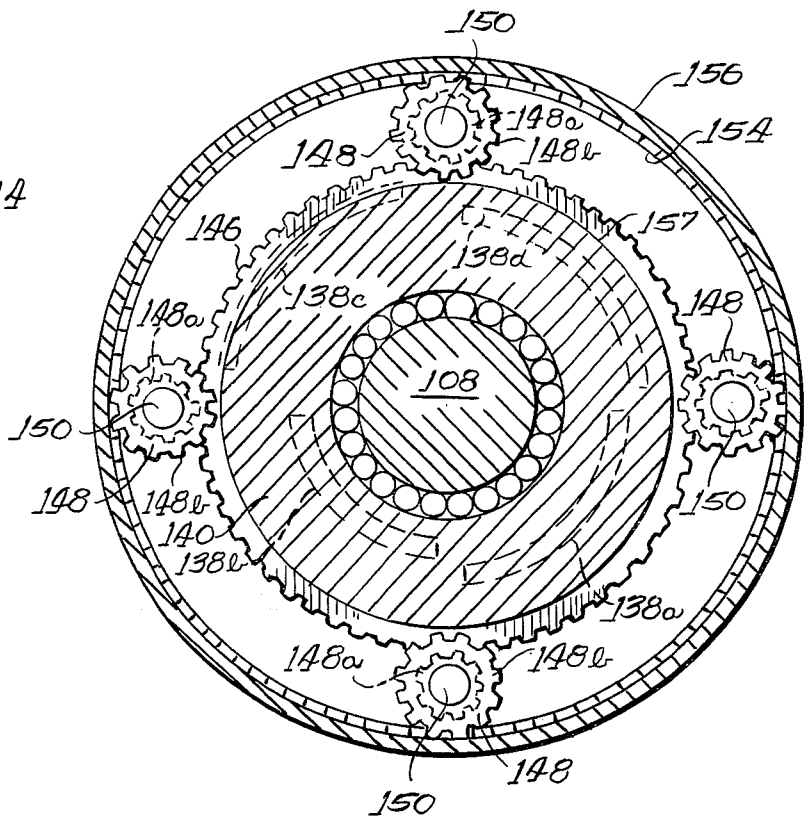
FIG. 4 is an enlarged partial transverse sectional view taken substantially along the line 4—4 of FIG. 1, looking in the direction of the arrows, and illustrates one of the planetary cam plates.

Each of the cam plates 140 and 142 has four arcuate cam lobes, designated 138*a,* 138*b,* 138*c* and 138*d,* formed thereon which are positioned at different radial distances from the axis of rotation of the respective cam plates. Each of the cam lobes 138*a–d* is operatively associated with two angularly adjacent push rods 136, as considered about the axes of the cam plates, so that during each rotation of the planetary cam plates 140 and 142, the associated intake and exhaust valves 129 and 130 are opened for a predetermined time peroid. The push rods 136 associated with each pair of intake and exhaust valves 129 and 130 are supported by the heads 40 and 42 at different radial distances from the axis of drive shaft 108 so that the push rods properly coact with their respective cam lobes 138*a–d.* The angles subtended by the arcuate cam lobes 138*a–d,* considered in FIG. 4, are equal so that the intake valves 129 associated with each of the pistons 14 and 16 are all opened and closed simultaneously, and the exhaust valves 130 are all opened and closed simultaneously in timed relation to the respective intake valves 124. It will be understood that "lifts" of the cam lobes 138*a–d* must be selected to effect equal opening of the respective intake and exhaust valves in cooperation with the various length rocker arms 131 so that equal volumes of fuel are introduced through each intake valve port.

Fuel supply means (not shown) of a conventional design are provided for introducing fuel charges, such as a carburized fuel-air mixture, into intake manifold passages 164 (FIG. 1) associated with the intake valves 129. Similar shaped exhaust manifold passages are provided for the exhaust valves 130 to receive exhaust gases when the exhaust valves are opened. Suitable covers (not shown) may be provided to overlie the rocker arms 131 and associated valves and push rods to protect them from dust and the like.

The ignition system for the engine 10 includes a distributor 168 having conventional breaker points, rotor and condenser. A distributor shaft 170 effects rotation of the rotor (not shown) within the distributor 168. The distributor has a center conductor 172 leading from the distributor cap to a conventional coil (not shown) which provides a high voltage to the distributor for effecting ignition within the combustion chambers through a plurality of spark plugs 174 (FIG. 2) in a conventional manner. In the illustrated embodiment, four spark plugs 174 are provided for each annular combustion chamber. The spark plugs 174 are connected to the distributor 168 through conventional spark plug wires or conductors 176.

The distributor shaft 170 is rotatably supported by the head 42 and extends into the housing such that a gear 178 secured on the inner end of the distributor shaft is disposed within the central chamber 34 within the housing 28. The gear 178 is connected in driven relation to a timing gear 180 which is affixed to the planetary cam gear 142 for rotation therewith, as shown in FIG. 1. Because the timing gear 180 is secured to the cam plate 142, the distributor shaft 170 will rotate in timed relation to rotation of the planetary cam plate 142, and thus also in timed relation to operation of the intake and exhaust valves 129 and 130, respectively.

While the engine 10 has been described as having intake and exhaust valves 129 and 130, and a conventional ignition system including distributor 168 to effect combustion within the combustion chambers, it will be understood that the engine 10 may be provided with a fuel injection system and a suitable electronic ignition system which could eliminate the distributor 168 and associated distributor shaft 170 and gear 178.

An oil pump 184 is supported within the head 42 and is suitably connected to the inner end of the drive shaft 108 to effect circulation of oil from an oil sump within housing 28 to the moving components of the engine 10 in a known manner. A fly wheel 186 is preferably provided on the drive shaft 108 and may be coupled to a starting motor (not shown) in a conventional manner to facilitate starting of the engine when the brake band 114 is in a braking position to retard rotation of the pistons and crankshafts about the axis of the drive shaft 108. An auxiliary drive shaft 188 may be rotatably supported by the head 42 and has a drive gear 190 thereon in driving relation with the gear 180. The drive shaft 188 may be employed to drive accessories such as the fuel pump, a fan and an alternator.

Having thus described the engine 10 in accordance with the present invention, its operation will now be briefly reviewed. With the fly wheel 186 coupled to a starting motor or other suitable means adapted to effect rotation of the drive shaft 108, the distributor 168 connected to a source of electrical energy, such as conventional ignition coil, the clamping brake 24 in a released nonclamping position which allows rotation of the pistons 14 and 16 and associated crankshafts 76 about the axis of the drive shaft 108, and with the intake manifold passages 164 connected to a suitable combustible fuel source, rotation of the drive shaft 108 will effect rotation of the crankshafts and pistons 14 and 16 about the axis of the drive shaft. The clamping band 114 is then momentarily clamped sufficiently to effect rotation of the crankshafts 76 about their own axes and cause reciprocating movement of the pistons 14 and 16 and rotation of the cam plates 140 and 142 to open the intake valves 129 in timed phase with piston position. When the intake valves 129 open to introduce fuel charges into the combustion chambers, the spark plugs effect ignition to start the engine. The clamping band 114 may then be released to allow continued operation or running of the engine without being power coupled to the drive shaft 108. In starting the engine, the clamping band 114 may be controlled by a simple mechanical or electronic feedback system.

Having once started the engine 10 as described, the clamping brake 24 may be actuated to clamp the gimbal ring 82 against rotation whereupon the rotational movement of the crankshafts 76 is transferred to the drive gear 106 to rotate the drive shaft 108. Proper timing is established between the intake and exhaust valves and firing of the spark plugs 156 through the fixed timed relationship of the planetary cam plates 140 and 142 with the crankshafts 76, and through the timing gear 180 and distributor shaft 170 as aforedescribed.

If the engine 10 is being employed in a vehicle such as an automobile, control means would be provided to relax the clamping brake 24 such that the pistons and associated connecting rods and crankshafts rotate about the axis of the drive shaft 108 when the drive shaft is rotated to initially start the engine, it being understood that the drive shaft would then be disengaged from the wheels of the vehicle. Such control means would be adapted, upon placing the automobile into a "drive" mode of operation, to actuate the clamping brake 24 and cause the brake band 114 to prevent further rotation of the outer gimbal ring 82 whereupon the reciprocating pistons would effect driving rotation of the drive shaft 108 through the crankshafts 76.

A governor could be provided on the drive shaft 108 to control actuation of the clamping brake 24 so that at a desired speed of the vehicle the clamping or braking action of the clamping brake would be complete and the crankshafts 76 would drive the drive shaft 108 without "slippage", the speed of the engine being determined by the fuel intake. When slowing the vehicle down or coming to a complete stop, the engine's compression will assist in deceleration. At a preselected desired speed, e.g. 5 to 10 m.p.h., the governor would be adapted to cause the clamping brake 24 to be released to allow rotation of the gimbal ring 82, crankshaft 76 and pistons 14 and 16 about the axis of the drive shaft 108.

Figure 8:
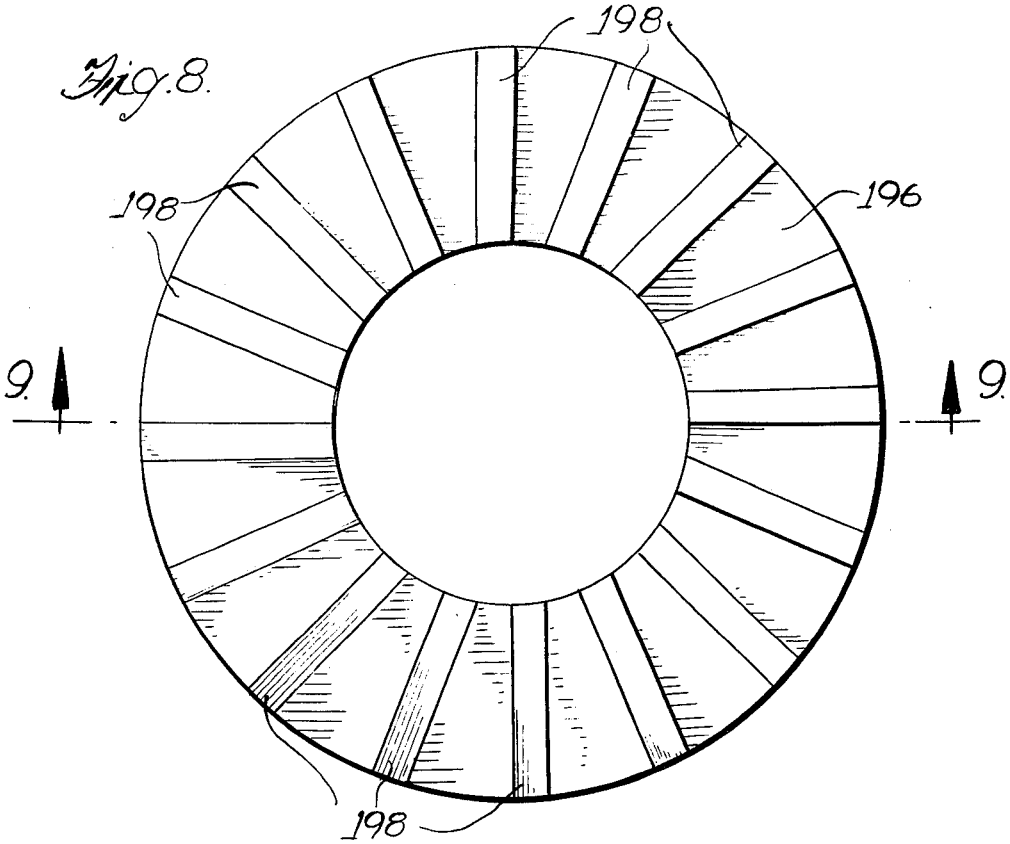
FIG. 8 is a top end view of an alternative embodiment of an annular piston in accordance with the present invention.
Figure 9:
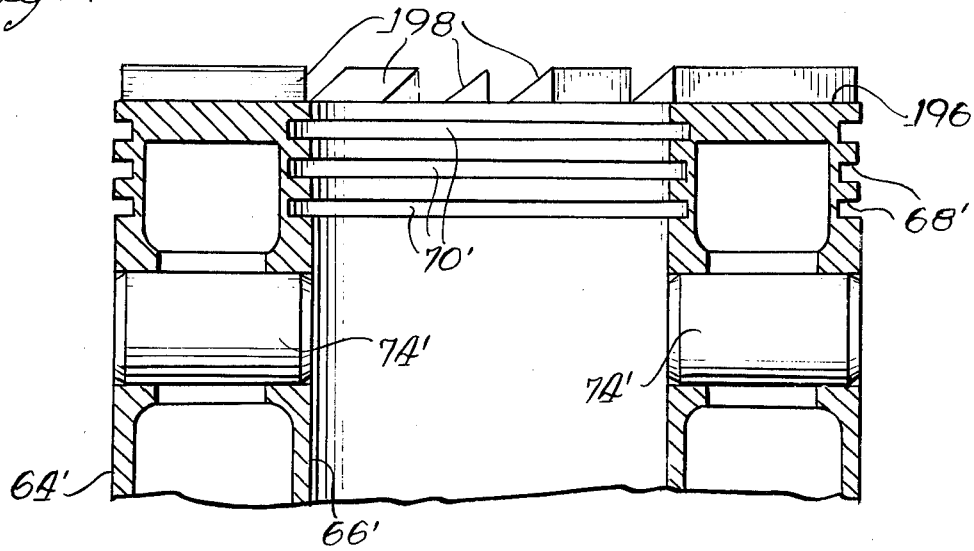
FIG. 9 is a partial longitudinal sectional view of the piston of FIG. 8, taken along the line 9—9 of FIG. 8 looking in the direction of the arrows.

FIGS. 8 and 9 illustrate an alternative embodiment of an annular piston, indicated generally at 194, for use in the aforedescribed engine 10. The annular piston 194 includes outer and inner annular skirt walls 64' and 66', respectively, and has a plurality of annular piston ring grooves 68' and 70' formed in the outer and inner annular walls, respectively, thereof to receive suitable piston rings. The piston 194 is adapted for connection to diametrically opposed connecting rods through wrist pins 74' in similar fashion to connection of the aforedescribed pistons 14 and 16. The piston 194 has an annular head surface 196 upon which is formed a plurality of inclined ramp or pressure surfaces 198 each of which lies in a plane inclined angularly outwardly from the plane of the head surface 196. The inclined pressure surfaces 198, of which there are 16 illustrated for the piston 194, are of sufficient surface area and are inclined at angles of inclination suitable to provide a piston rotation biasing force from the combustion of fuel charges within the combustion chambers during operation of the engine such that the piston is biased in a predetermined rotational direction about its own axis. By biasing the piston 194 in the rotational direction which the piston normally rotates during operation of the engine, the initial friction forces tending to resist piston rotation during engine start-up, or when going from an "idle" to a "drive" mode of operation, are substantially overcome.

To facilitate flame propagation during combustion within the annular combustion chambers 30 and 32, the fuel may be introduced into the combustion chambers on substantially diametrically opposed sides thereof. Fuel discharge nozzles (not shown) would be provided to discharge fuel into the combustion chambers in the form of fan sprays each of which would cover approximately one-half of an annular combustion chamber area. With such distribution of the combustible fuel mixture within the annular chambers, uniform combustion is facilitated which effects a corresponding reduction in nonburned residual fuel combustion products.

Figure 11:
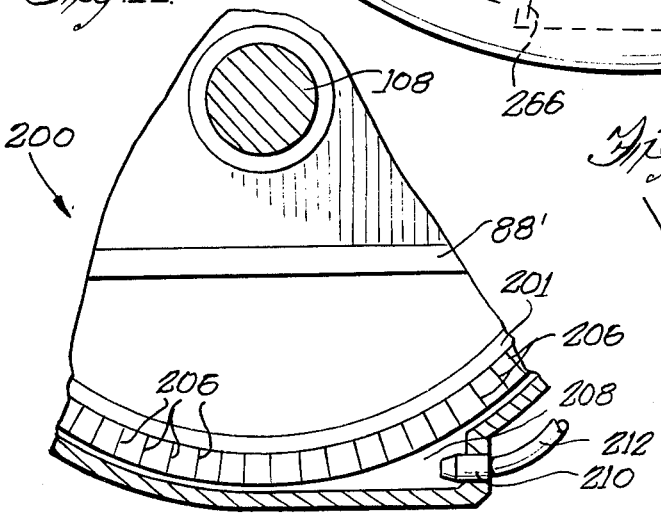
FIG. 11 is a partial transverse sectional view of the gimbal frame and housing of FIG. 10.
Figure 10:
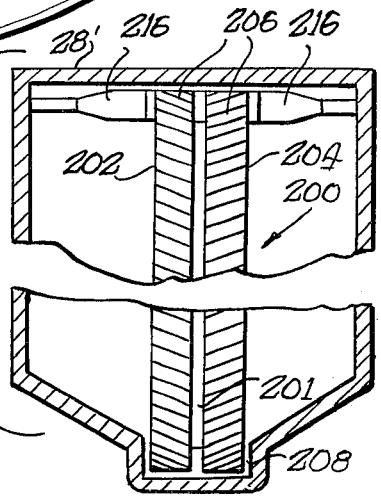
FIG. 10 is a foreshortened partial longitudinal sectional view of an alternative engine housing with an alternative gimbal frame disposed therein.

FIGS. 10 and 11 illustrate an alternative embodiment of a gimbal frame, indicated generally at 200, for use in the engine 10. The gimbal frame 200 is disposed within a housing 28' at a position equivalent to the position of the gimbal ring 82 in the embodiment of FIG. 1. The gimbal frame 200 includes an annular gimbal ring 201 which has a generally C-shaped beam 88' secured on a diameter thereof to facilitate mounting of the gimbal frame on the drive shaft 108 in similar fashion to the mounting of the above-described gimbal ring 82. The gimbal ring 201 carries a pair of axially spaced rings 202 and 204 the outer peripheral surface of which have vanes 206 formed thereon. The vanes 206 are radial to the axis of rotation of the gimbal frame and are inclined so that the vanes on the spaced ring 202 and 204 cooperate to form a herringbone pattern as shown in FIG. 10.

The lower portion of the housing 28' is formed to provide a recess or shallow trough 208 to receive the vane rings 202 and 204 in close tolerance relation therewith as the gimbal frame is rotated within the housing 28'. The shallow trough 208 may form a part of the oil sump of the engine crank case or housing 28'. A suitable hydraulic fluid discharge nozzle 210 and associated hydraulic fluid supply hose 212 are secured to the housing 28' so that the nozzle 210 projects within the trough 208 as shown in FIG. 11. The hose 212 is connected to a suitable source of hydraulic fluid under pressure, such as the aforedecribed pump 184, and a flow control valve (not shown) so that fluid under pressure may be selectively discharged through the nozzle 210 into the trough 208.

Because the trough 208 is in close tolerance relation with the vane rings 202 and 204, fluid under pressure introduced into the trough through nozzle 210 will subject the vanes to hydrostatic pressure. Assuming the gimbal frame 200 to be assembled on the drive shaft 108 within the engine 10 and freely rotating as during an "idle" mode of operation of the engine, suitable fluid pressure introduced through the discharge nozzle 210 will create a hydrostatic pressure undershot effect on the vanes 206 and slow the rotational speed of the gimbal frame. By continually applying suitable hydrostatic pressure against the vanes 206, the gimbal frame may be caused to stop rotating relative to the engine housing. Thereafter, continued application of suitable fluid pressure to the trough 208 through the discharge nozzle 210 will reverse the direction of rotation of the gimbal frame 200. In the latter condition, the gimbal frame 200 is caused to rotate in the same direction as the output shaft 108 being driven by the reciprocating pistons. The effect of such added rotation to the output shaft 108 for a given piston speed will effect an overdrive mode of operation, the drive shaft 108 being then rotated by both the reciprocating pistons and the rotating gimbal frame.

With the gimbal frame embodiment 200, disc clutch members 216 (FIG. 10) are mounted within the housing 28' adjacent the upper end thereof for engagement with the lateral edges of the rings 202 and 204. The disc clutch members 216 serve as clutching means for selectively preventing free rotation of the gimbal frame 200 during engine start-up wherein it is necessary to momentarily resist rotation of the gimbal frame to induce reciprocating piston movement. The disc clutch members 216 may also be used in conjunction with the gimbal frame 200 to maintain the gimbal frame in fixed nonrotating relation to the engine housing and facilitate engine operation at low speeds when the overdrive mode of operation is not utilized.

Figure 13:
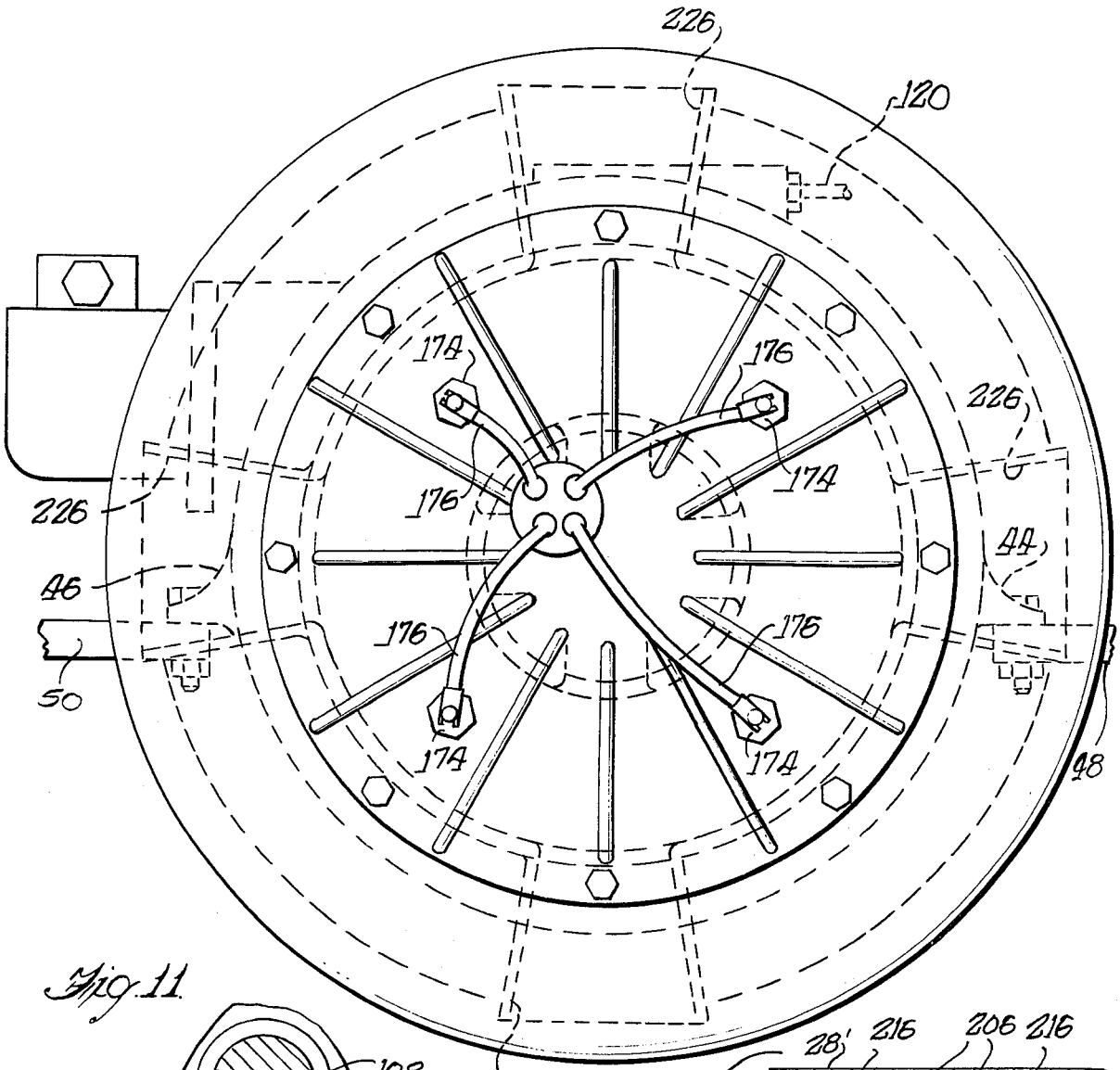
FIG. 13 is an end view of the two cycle engine of FIG. 12, taken substantially along the line 13—13 of FIG. 12 looking in the direction of the arrows.
Figure 12:
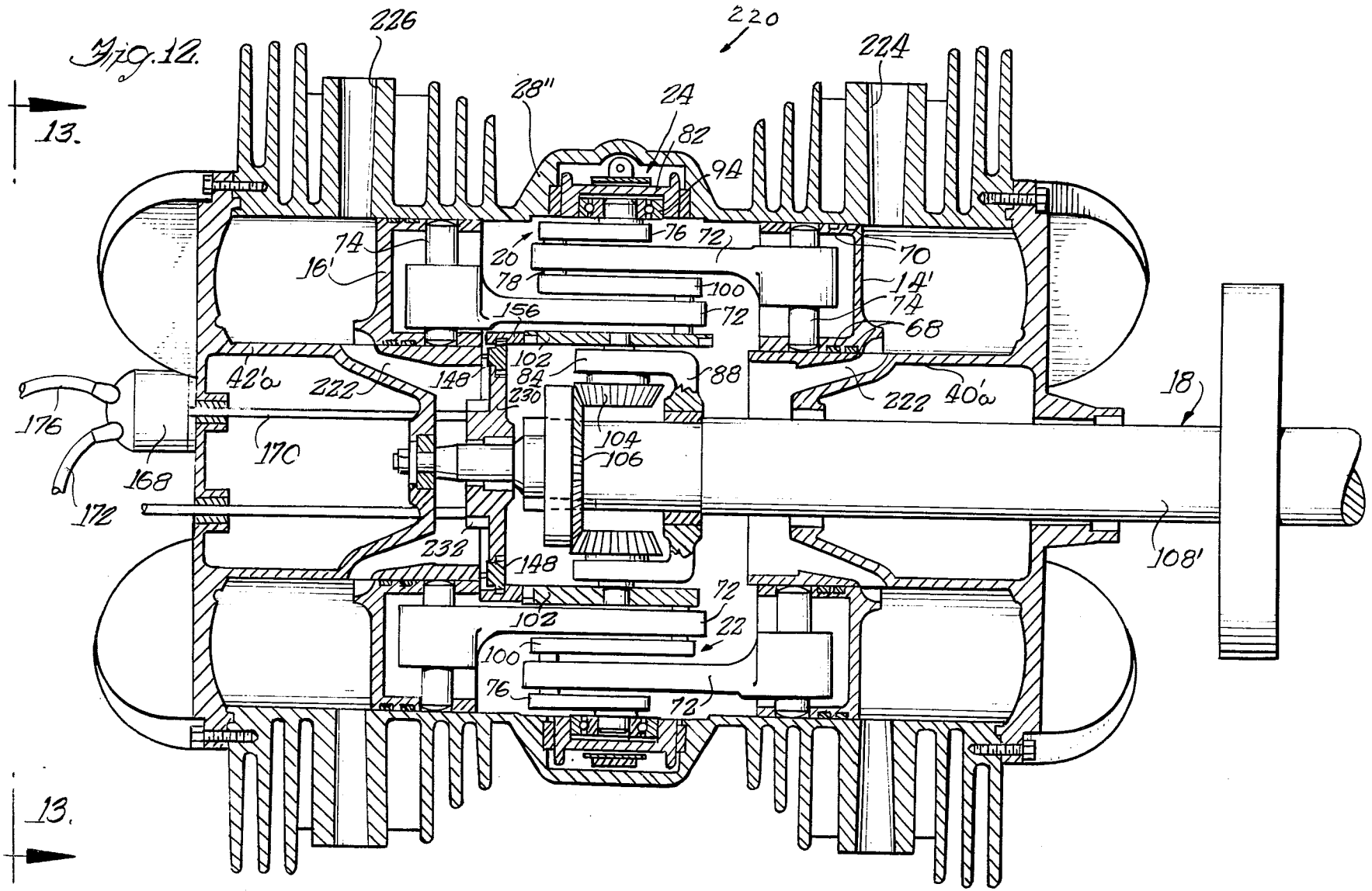
FIG. 12 is a longitudinal sectional view of a two cycle engine constructed in accordance with the present invention.

FIGS. 12 and 13 illustrate an engine, indicated generally at 220, constructed in accordance with the present invention in the form of a two-cycle engine. The two-cycle engine 220 is generally similar in internal components as the above-described engine 10 in that it employs axially reciprocal and rotatably pistons 14 and 16 connected through connecting rods 72 to crankshafts 76 the axes of which intersect the axis of an output shaft 108' and lie in a plane normal to the output shaft 108'. The crankshafts 76 have bevel gears 104 secured on their radially inward ends which are cooperable with a bevel gear 106 fixed on the drive shaft 108'. The outer ends of the crankshafts 76 are carried in a gimbal frame ring 82 in similar fashion to the engine 10. The engine 220 differs from the described four-cycle engine 10 in that the intake and exhaust valves 29 and 30 are dispensed with.

To facilitate the introduction of combustible fuel mixtures into the combustion chambers of engine 220, cylinder heads 40' and 42' are provided which have axially inwardly projecting annular walls **40'*a* and 42'*a*, respectively, which define intake channels or passages 222 through which fuel may be introduced into the combustion chambers when the pistons 14 and 16 are in their bottom dead center positions. The engine 220 has an exterior housing 28'' which has exhaust ports 224 and 226 formed therein for cooperation with the combustion chambers 30' and 32', respectively, to exhaust the products of combustion during the terminal portions of the piston power strokes as is known. It will be appreciated that the fuel inlet passages 222** are connected to a suitable fuel charge supply means (not shown) for introducing combustible fuel mixtures into the combustion chambers.

With the elimination of intake and exhaust valves and their associated rocker arms and push rods, the two-cycle engine 220 does not require planetary cam plates such as described above in respect to the engine 10. Rather, the two-cycle engine 220 employs a single planetary plate 230 which is driven through idler gears 148 to an annular timing ring gear 156 and thereby to the timing spur gears 102 carried on the crankshafts 76 in a similar manner as above described in respect to driving connection of the planetary cam plates 140 and 142 to the timing spur gears 102. The planetary plate 230 has a timing gear 232 formed thereon and rotatable therewith which is connected to a spur gear (not shown) on the inner end of a distributor shaft 170 which effects operation of a distributor 168 in timed relation to the position of the pistons 14 and 16. Combustion is effected by spark plugs 174 (FIG. 13) which are connected to the distributor 168 through spark wires 176. In other respects, the two-cycle engine 220 operates in a manner similar to the aforedescribed four-cycle engine 10.

The engines 10 and 220 in accordance with the present invention provide many advantages over conventional engine designs. In particular, the annular pistons 14 and 16 provide, through proper selection of the total area of the working surfaces 62 thereof, favorable comparison with conventional 8 or 6 cylinder engines. For example, a two cylinder rotoreciprocating engine such as above described having a mean piston diameter of 9 inches and a radial width of the piston face 62 of 1½ inches would have a total piston "working" area of approximately 84 square inches. This would be substantially equivalent to an eight cylinder engine of conventional design having piston diameters of approximately 3½ inches.

Engines in accordance with the present invention could be arranged in tandem, in line, or radially about a common drive shaft, and offer a number of additional advantages over conventional internal combustion engines. For example, to provide cleaner engine performance, the pistons 14 and 16 and their associated piston chambers could be configured to provide different compression ratios for each cylinder. The exhaust gases from one cylinder could be discharged into a surge manifold and then ingested into the opposite cylinder having the greater compression for complete burning of the fuel. More complete combustion, and thus higher efficiency, will result during rotation of the pistons due to increased turbulence in the combustion chambers which produces more uniform firing and scavenging.

Since the load on the engine is reduced during starting through the provision of rotating pistons and associated crankshafts, cold weather starting may be substantially improved since the load on the crankshafts need not be taken up until called upon, namely, when the engine reaches a suitable operating temperature.

By the employment of pistons which rotate as well as reciprocate, a point on the peripheral surface of each piston will undergo a helical motion during rotation and reciprocation of the pistons. Thus such movement of the pistons provides a self-sealing effect due to friction wear during operation of the engine.

While preferred embodiments of the rotoreciprocating engines 10 and 220 in accordance with the present invention have been illustrated and described, it will be obvious to those skilled in the art that changes and modifications may be made therein without departing from the invention in its broader aspects. Various features of the invention are defined in the following claims.

What is claimed is:

1. An internal combustion engine comprising, in combination, housing means defining a longitudinal axis, at least two axially aligned piston receiving chambers within said housing means, said piston receiving chambers having annular configurations and each chamber being substantially closed at one end and open at its opposite end such that the open ends of said chambers are in substantially axially opposed relation, an annular piston disposed within each of said piston receiving chambers means mounting said pistons for reciprocal and rotatable movement within said chambers, said pistons being rotatable about a common axis and each cooperating with its associated piston receiving chamber to define an annular combustion chamber, at least one connecting rod pivotally connected to each of said pistons and extending generally parallel to the axis of rotation of said pistons, drive shaft means supported by said housing means for rotation about an axis coincident with the common axis of said annular pistons, said drive shaft means extending outwardly of said housing means, means interconnecting said connecting rods to said drive shaft means so as to effect selective rotation of said drive shaft means upon reciprocating movement of said pistons, and means for introducing combustible fuel into said combustion chambers and effecting ignition of said fuel in a manner to effect reciprocating movement of said pistons.

2. An internal combustion engine as defined in claim 1 wherein the axis of said two axially aligned piston receiving chambers is substantially coincident with said longitudinal axis of said housing means.

3. An internal combustion engine as defined in claim 2 wherein each of said pistons has an annular working face lying in a plane substantially perpendicular to the axis of said pistons, each of said pistons further having a skirt portion defined by radially spaced coaxial annular wall surfaces.

4. An internal combustion engine as defined in claim 3 wherein each of said pistons has a pair of connecting rods pivotally connected to said skirt portion thereof, said connecting rods associated with each of said pistons being in substantially diametrically opposed relation relative to the axis of rotation of said pistons.

5. An internal combustion engine as defined in claim 1 wherein said pistons include means responsive to ignition of fuel within said combustion chambers for biasing said pistons in selected rotational directions about said common axis.

6. An internal combustion engine as defined in claim 5 wherein each of said pistons has an annular working face lying in a plane substantially perpendicular to the axis of said pistons, and wherein said means on said pistons for biasing said pistons in selected rotational directions comprises a plurality of pressure surfaces formed on said working face of each piston, said pressure surfaces being inclined outward from said working faces of said pistons so that a force component acts normal to said pressure surfaces upon ignition of fuel within said combustion chambers.

7. An internal combustion engine as defined in claim 1 wherein said drive shaft means comprises a drive shaft supported by said housing for rotation about an axis substantially coincident with the axis of rotation of said pistons, and including fly wheel means mounted on said drive shaft externally of said housing means.

8. An internal combustion engine as defined in claim 1 wherein said means for introducing combustible fuel into said combustion chambers and effecting ignition thereof includes intake and exhaust valve means cooperable with said combustion chambers and selectively operable to facilitate the introduction of a combustible fuel charge into said combustion chambers and effect discharge of exhaust gases therefrom after combustion of said fuel charges.

9. An internal combustion engine as defined in claim 8 including planetary cam plate means mounted for rotational movement in timed relationship to reciprocating movement of said pistons, and means interconnecting said planetary cam plate means to said intake and exhaust valve means so as to effect sequential opening and closing of said intake and exhaust valve means in timed relation to reciprocating movement of said pistons.

10. An internal combustion engine as defined in claim 9 wherein said means interconnecting said planetary cam plate means to said intake and exhaust valve means includes push rod means operatively interconnecting said planetary cam plate means and said intake and exhaust valve means, said push rod means being supported by said housing means for axial movement.

11. An internal combustion engine as defined in claim 1 wherein said means interconnecting said connecting rods to said drive shaft means so as to effect rotation of said drive shaft means upon reciprocating movement of said pistons includes crankshaft means supported for rotation about an axis lying in a plane substantially normal to the axis of rotation of said annular pistons, said crankshaft means being connected to said connecting rod means such that reciprocating movement of said annular pistons effects rotation of said crakshaft means about its said axis of rotation.

12. An internal combustion engine as defined in claim 11 wherein said annular pistons are interconnected to said crankshaft means such that said pistons reciprocate in opposite directions along their said common axis during operation of said engine.

13. An internal combustion engine as defined in claim 11 wherein said crankshaft means includes a pair of axially aligned crankshafts the common axis of which intersects said axis of rotation of said annular pistons and lies in a plane substantially normal thereto.

14. An internal combustion engine as defined in claim 9 wherein said means for introducing a combustible fuel into said combustion chambers and effecting selective ignition thereof includes a plurality of combustion initiating elements disposed within said combustion chambers, and means for effecting selective ignition of said combustion ignition means in timed relation to rotational movement of said planetary cam plate means.

15. An internal combustion engine as defined in claim 11 including gimbal frame means supporting said crankshaft means for rotation about the axis of said annular pistons in a plane substantially normal to said axis of said pistons, and clutching or clamping brake means operatively associated with said gimbal frame means and adapted to selectively prevent rotation of said crankshaft means and said associated annular pistons about the axis of rotation of said annular pistons such that reciprocating movement of said pistons effects driving rotation of said drive shaft means.

16. An internal combustion engine as defined in claim 15 wherein said clamping brake means is operative to release said gimbal frame means and allow rotation of said crankshaft means and said pistons about said axis of said pistons so as to facilitate reciprocating movement of said pistons without effecting driving rotation of said drive shaft means.

17. An internal combustion engine as defined in claim 15 wherein said means for introducing combustible fuel into said combustion chambers and effecting ignition thereof includes intake and exhaust valve means cooperable with said combustion chambers, planetary cam plate means mounted for rotational movement in planes substantially normal to the axis of said drive shaft means, means interconnecting said planetary cam plate means to said intake and exhaust valve means so as to effect sequential opening and closing of said intake and exhaust valve means, and gear means interconnecting said cam plate means to said crankshaft means to maintain said planetary cam plate means in timed relation to movement of said piston means irrespective of rotational movement of said crankshaft means about the axis of said drive shaft means.

18. An internal combustion engine as defined in claim 11 including gimbal means supporting said crankshaft means for rotation about its own axis, said gimbal means being rotatable about an axis coincident with the axis of said drive shaft means so as to rotate said crankshaft means about said axis of said drive shaft means upon rotation of said gimbal means, and including fluid pressure means operatively associated with said gimbal means to selectively control rotation thereof about said axis of said drive shaft means.

19. An internal combustion engine as defined in claim 18 wherein said gimbal means includes an annular gimbal ring having an axis of rotation coincident with said axis of said drive shaft means and lying in a plane substantially perpendicular to said axis of said drive shaft means, said gimbal ring having a plurality of radial vanes disposed about its peripheral surface, and wherein said fluid pressure means includes a trough formed in said housing means and adapted to receive said vanes therein during rotation of said gimbal ring, and a fluid pressure nozzle means associated with said trough and adapted to apply fluid pressure against said vanes in a manner to stop rotation of said gimbal ring and selectively control the direction of rotation thereof relative to said drive shaft means.

20. An internal combustion engine as defined in claim 19 including clutch means operatively associated with said gimbal ring and operative to prevent rotation thereof independently of said fluid pressure means.

21. An internal combustion engine as defined in claim 13 which includes a pair of diametrically opposed connecting rods pivotally connected to each of said pistons, the connecting rods of each pair of connecting rods being connected, respectively, to said axially aligned crankshafts such that the connecting rods of each pair of connecting rods rotate in opposite rotational directions relative to each other during reciprocating movement of said pistons.

22. An internal combustion engine comprising, in combination, housing means defining a longitudinal axis, at least two axially aligned annular piston receiving chambers within said housing means the common axis of which is coincident with said longitudinal axis of said housing means, said piston receiving chambers each being substantially closed at one end thereof and open at the opposite end such that the open ends of said chambers are in substantially axially opposed relation, an annular piston disposed within each of said piston receiving chambers and being reciprocally and rotatably slidable therein, said pistons cooperating with said housing means to define an annular combustion chamber for each of said pistons, at least one connecting rod pivotally connected to each of said pistons and extending generally parallel to the axis of said piston chambers, drive shaft means supported by said housing means for rotation about an axis coincident with the common axis of said pistons, said drive shaft means extending outwardly of said housing, fuel control means for introducing combustible fuel into said combustion chambers, said fuel control means including valve means cooperable with said substantially closed ends of said piston receiving chambers and selectively operable to facilitate the introduction of combustible fuel into said combustion chambers and effect discharge of exhaust gases after combustion of said fuel, means for effecting combustion of fuel introduced into said combustion chambers so as to effect reciprocating movement of said pistons, crankshaft means interconnecting said connecting rods to said drive shaft means so as to facilitate selective rotation of said drive shaft means upon reciprocating movement of said pistons, gimbal means supporting said crankshaft means for rotation about an axis which intersects the axis of said drive shaft means and lies in a plane substantially normal to said axis of said drive shaft means, said gimbal means also facilitating selective rotation of said crankshaft means and said pistons about said axis of said drive shaft means during reciprocating movement of said pistons, and clamping brake means operatively associated with said gimbal means and operable between a first position preventing rotation of said crankshaft means and said pistons about said axis of said drive shaft such that reciprocating movement of said pistons effects rotation of said drive shaft, and a second position allowing said rotation of said crankshaft means and pistons about said axis of said drive shaft means so that reciprocating movement of said pistons will cause rotation of said pistons and crankshafts about said drive shaft means when said drive shaft means is prevented from rotating.

23. An internal combustion engine as defined in claim 22 wherein said valve means includes a plurality of intake and exhaust valves supported by said housing means for cooperation with each of said combustion chambers, said intake and exhaust valves associated with each of said combustion chambers being disposed in a circular array in alternating angularly spaced relationship about the circumference of said circle, said fuel control means further including a push rod operatively associated with each of said intake and exhaust valves, each of said push rods being supported by said housing means for axial movement and extending within said housing means generally parallel to the axis of said pistons, and cam plate means operatively associated with said push rods to effect movement thereof to operate the associated intake and exhaust valves in timed relationship to reciprocating movement of said pistons.

24. An internal combustion engine as defined in claim 23 wherein said cam plate means includes a pair of planetary cam plates rotatable about the axis of said drive shaft and lying in planes substantially normal to said axis of said drive shaft, each of said planetary cam plates being operatively associated with the intake and exhaust valves associated with one of said combustion chambers, each of said planetary cam plates having a plurality of cam lobes thereon each of which is operative to effect movement of a pair of adjacent intake and exhaust valves.

25. In combination, housing means, a rotatable drive shaft supported by said housing means, a pair of opposed reciprocative and rotatable pistons disposed within said housing means, means for effecting movement of said pistons in power strokes, at least one crankshaft, gimbal means supported by said housing means and supporting said crankshaft with the longitudinal axis of said crankshaft intersecting the axis of said drive shaft and lying in a plane perpendicular to said axis of said drive shaft, said gimbal means further being rotatable about an axis coincident with the axis of said drive shaft and supporting said crankshaft for rotation within said perpendicular plane about the axis of said drive shaft, means interconnecting said crankshaft to said pistons so as to effect rotation of said crankshaft about its longitudinal axis and effect reciprocating movement of said pistons upon movement of said pistons in said power strokes, gear means positively interconnecting said crankshaft to said drive shaft, and control means cooperative with said gimbal means to selectively control rotation thereof about its said axis of rotation so as to control the rotational speed of said drive shaft for a given reciprocating speed of said pistons whereby said crankshaft, gimbal means and control means provide a stepless transmission between movement of said pistons and rotation of said drive shaft.

26. The combination as defined in claim 25 wherein said gimbal means includes an annular gimbal ring lying in a plane substantially perpendicular to the axis of said drive shaft, and wherein said control means includes a clutching means or clamping band cooperable with the outer peripheral surface of said gimbal ring and operative to tighten against said gimbal ring to selectively control rotation of said gimbal ring between rotatable and stop conditions.

27. The combination of claim 25 wherein said control means includes fluid pressure means operatively associated with said gimbal means to selectively control rotation thereof about said axis of said drive shaft means.

28. The combination as defined in claim 27 wherein said gimbal means includes an annular gimbal ring having a plurality of radial vanes disposed about its peripheral surface, and wherein said fluid pressure means includes a trough formed in said housing means and adapted to receive said vanes therein during rotation of said gimbal ring, and fluid pressure nozzle means associated with said trough and adapted to apply fluid pressure against said vanes in a manner to stop rotation of said gimbal ring and selectively control the direction of rotation thereof relative to said drive shaft means whereby to control the rotational speed of said drive shaft.

* * * * *

UNITED STATES PATENT AND TRADEMARK OFFICE

CERTIFICATE OF CORRECTION

PATENT NO. : 4,043,301

DATED : August 23, 1977

INVENTOR(S) : Lawrence M. Rheingold

It is certified that error appears in the above-identified patent and that said Letters Patent are hereby corrected as shown below:

Col. 3, line 45, "as" should be --at--.

Col. 4, line 26, "19" should be --18--.

Col. 6, line 52, "peroid" should be --period--.

Col. 7, line 65, after "as" insert --a--.

Col. 9, line 25, after "annular" insert --combustion--.

Col. 9, line 55, "aforedecribed" should be --aforedescribed--.

Col. 10, line 33, "rotatably" should be --rotatable--.

Col. 13, line 28, Claim 11, "crakshaft" should be --crankshaft--.

Col. 13, lines 44 and 45, Claim 14, "chanbers" should be --chambers--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*